US005253025A

United States Patent [19]

Mitsuya et al.

[11] Patent Number: 5,253,025

[45] Date of Patent: Oct. 12, 1993

[54] APPARATUS FOR FIXING A TONER IMAGE, FIXING METHOD AND ELECTROPHOTOGRAPHIC RECORDING EQUIPMENT

[75] Inventors: Teruaki Mitsuya; Takashi Suzuki; Kazuo Uno, all of Katsuta, Japan

[73] Assignees: Hitachi, Ltd.; Hitachi Koki Co., Ltd., both of Tokyo, Japan

[21] Appl. No.: 796,013

[22] Filed: Nov. 22, 1991

[30] Foreign Application Priority Data

Nov. 28, 1990 [JP] Japan ..... 2-322701

[51] Int. Cl.[5] ..... G03G 13/20

[52] U.S. Cl. ..... 355/285; 358/300; 430/99

[58] Field of Search ..... 430/99, 125; 355/285; 358/300

[56] References Cited

U.S. PATENT DOCUMENTS 4,565,762 1/1986 Kato ..... 430/99
4,791,455 12/1988 Yamamoto et al. ..... 430/125
5,061,965 10/1991 Ferguson et al. ..... 430/99

*Primary Examiner*—John Goodrow
*Attorney, Agent, or Firm*—Kenyon & Kenyon

[57] ABSTRACT

An apparatus fixes a toner image formed on a recording medium and has a fixing roller which is rotated. The fixing roller is heated and the toner image is fixed on the recording medium being in pressed contact with said fixing roller. Offset toner particles formed on the fixing roller are decomposed into particles being too small to be perceived as a picture by an offset toner decomposing device before such large particles to be perceived as a picture are formed, and the small offset toner particles are stuck onto and removed by the recording medium. Preferably, the offset toner decomposing device is a brush roller which is rotated relative to the rotation of the fixing roller such that the brush roller and the fixing roller have equal peripheral speeds. The amount of offset toner being formed is decreased by reducing the creation of offset toner particles on the fixing roller by decreasing a torque fluctuation of a drive motor of the fixing roller.

32 Claims, 6 Drawing Sheets

| K(N/m) | LOAD CURRENT FLUCTUATION AREA | EXISTENCE OF PERCEIVABLE OFFSET |
|---|---|---|
| $1.6\times10^{6}$ | X | YES |
| $1.2\times10^{6}$ | X | YES |
| $4.0\times10^{5}$ | ○ | NO |

APPARATUS FOR FIXING A TONER IMAGE, FIXING METHOD AND ELECTROPHOTOGRAPHIC RECORDING EQUIPMENT

BACKGROUND OF THE INVENTION

The present invention relates a printing or recording apparatus employing electrophotography, such as printer, copying machine and facsimile transmitter. More particularly, it relates to a fixing apparatus wherein a toner image formed on the surface of a recording medium is fixed to the recording medium.

A conventional fixing apparatus has, at least, a heat roller. By the way, in this specification, the heat roller and a backup roller will be sometimes abbreviated as "HR" and "BR", respectively, for the sake of brevity. Both the rollers HR and BR shall be called a "pair of fixing rollers". Besides, any one of the HR and BR will be called a "fixing roller" in some cases. In the fixing apparatus, toner sometimes adheres to the fixing roller in case of fixing a toner image. This phenomenon is termed "offset", while the toner adherent to the fixing roller is termed "offset toner". In a case where there is a large amount of offset toner, there arises the problem that the offset toner remigrates onto a recording medium and becomes indistinguishable from recorded information thereby causing misprints to occur.

FIG. 1 is a diagram showing the known appearance characteristic of the offset toner in dependence of temperature. Numeral 19 designates a low temperature region, numeral 20 a high temperature region, and numeral 21 a non-offset band. The abscissa represents the temperature of the fixing roller, while the ordinate axis represents the quantity of the offset toner. The quantities of the offset toner are large in the low temperature region 19 and the high temperature region 20. The offset occurring in the low temperature region 19 is termed "low temperature offset", while the offset occurring in the high temperature region 20 is termed "high temperature offset". The region between the low temperature region 19 and the high temperature region 20 is termed the "non-offset band 21", in which the quantity of the offset toner is small. In the fixing apparatus, the temperature of the fixing roller is usually set within the non-offset band 21 to decrease the quantity of the offset toner to the utmost. However, in the conventional device, even when the temperature of the fixing roller is set within the non-offset band 21, some offset takes place, offset toner is gradually accumulated and the above-mentioned misprint problem arises.

Japanese Patent Application Publication No. 15072/1990 discloses is by way of example, a cleaning device using bristles by which the bristles are endowed with a release agent, whereby the caught offset toner adherent to the bristles is separated from these bristles. However, this causes the problem that the offset toner separated from the bristles pollutes the interior of the fixing apparatus.

SUMMARY OF THE INVENTION

In accordance with the present invention a printing or recording apparatus and a recording method, in which offset toner exists on a fixing roller, does not create visible misprints on a following recording medium.

The present invention provides a printing or recording apparatus in which the occurrence of offset toner is reduced with high reliability to prevent the occurrence of the perceivable misprints.

According to a first embodiment of the present invention, offset toner particles formed on the fixing roller are decomposed into such small particles, unperceivable as a picture, by an offset toner decomposing device before such large particles that could be perceived as a picture on a following recording medium are formed on the fixing roller. Hereby, large offset toner particles that would be perceived as a picture on a following recording medium are decomposed. After the inventive decomposition the offset toner particles are of such a size that, when migrating onto a recording medium, the corresponding picture on that recording medium due to that particle is unperceivable. Preferably, the decomposing device is a brush roller which is rotated such that the rotation of the fixing roller and the brush roller have equal peripheral speeds. The decomposing device may be intermittently brought into contact with the fixing roller. In this case, while the brush roller is not in contact with the fixing roller, a wiping roller may be held in contact with the fixing roller.

According to a further embodiment of the present invention, offset toner particles formed on a fixing roller are wiped away by a wiping roller which is intermittently brought into contact with the fixing roller before the offset toner reaches the size perceivable as a picture.

The offset toner adhering to the fixing roller consists of unperceivably small particles at the initial stage of printing immediately after the start. Some of the particles remigrate onto the recording medium to be subsequently fixed on a recording medium without being perceivable on it as a picture, thereby being discharged out of the recording apparatus. However, some offset toner particles remain on the fixing roller without remigrating onto the recording medium immediately. As the number of printed sheets increases, the remaining offset toner particles couple to one another on the surface of the fixing roller and grow into large particles. Eventually, the particles reach sizes at which they are perceivable as a picture on the recording medium. Some of these large particles eventually remigrate onto the recording paper and give rise to perceivable misprints.

A second embodiment of the present invention addresses this problem of the migration of offset toner to the fixing roller. The amount of offset toner migrating onto the fixing roller when fixing a toner image is reduced by decreasing a torque fluctuation of said rotatable fixing roller and in particular a torque fluctuation of a drive motor of said rotatable fixing roller. Further the torque fluctuation may be decreased by absorbing an impact shock caused by a front end of the recording medium entering a gap between the pair of fixing rollers. Such an impact shock is absorbed by mechanism which applies a pressure to hold the pair of fixing rollers pressed against each other.

BRIEF DESCRIPTION OF THE DRAWINGS

These and other objects, features and advantages of the present invention will be understood more clearly from the following detailed description with reference to the accompanying drawings, wherein

FIG. 8 is a diagram showing the change in the load currents for the "HR" drive motor as a function of time, from the time when the front end of a recording medium is moved in.

DETAILED DESCRIPTION

Figure 4:
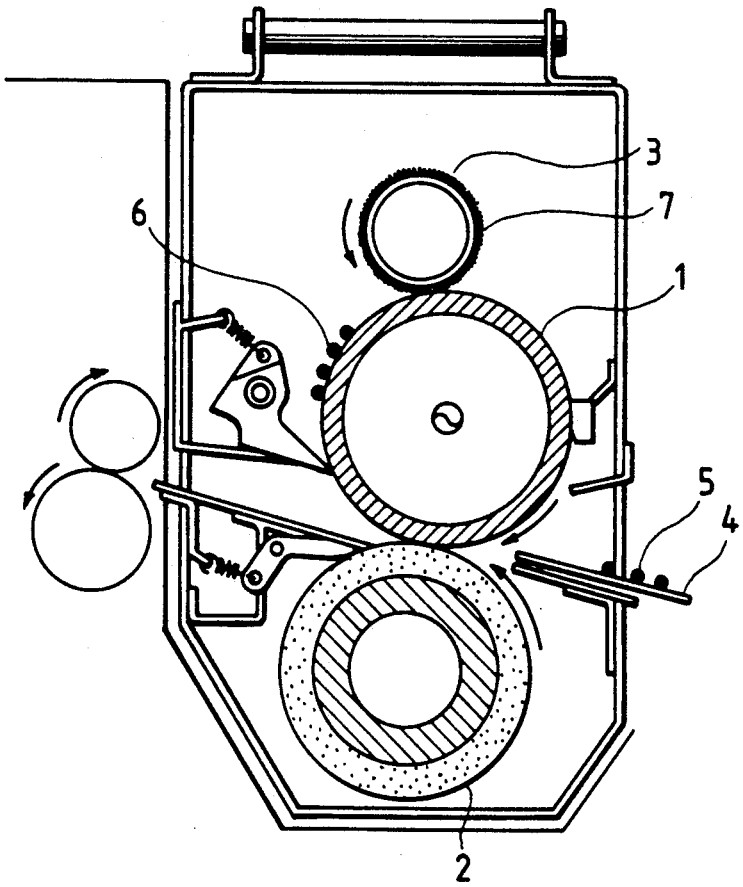
FIG. 4 is a sectional side view of a fixing apparatus according to an embodiment of the present invention.

FIG. 4 is a sectional side view a fixing apparatus in accordance with a first embodiment of the present invention. Numeral 1 designates a heat roller (HR), numeral 2 a backup roller (BR), numeral 3 a brush roller, numeral 4 a recording paper, numeral 5 toner, numeral 6 offset toner, and numeral 7 bristles. The HR 1 is heated, and the HR 1 and the BR 2 are rotated in pressed contact. The toner 5 forming an array as a picture on the front surface of the recording paper 4 is fixed by inserting this recording paper 4 between the contact surfaces of the rollers. Here, at least one of the fixing rollers may be kept heated.

When a fixed toner image formed on the recording paper is to be inserted between the fixing rollers, the recording paper is inserted so that its surface bearing the toner image may come into contact with the heated fixing roller. Further, there shall be covered a case where the recording medium 4 is inserted between the HR 1 and the BR 2 with an already fixed toner image facing the HR 1 (multi-step copy) or a case where the recording medium 4 is inserted between the HR 1 and the BR 2 with an already fixed toner image facing the BR 2 (two-sided copy).

The bristles 7 of the brush roller 3 are made of nylon fibers, and the brush roller 3 is rotated such that is has the same peripheral speed as the rotation of the HR 1 so as to decompose the offset toner 6 without scraping it off or removing it from the HR 1. The decomposed toner on the HR 1 is subsequently stuck onto and removed by the following recording paper for printing.

As the brush roller 3 and the HR 1 rotate with the same peripheral speed the offset toner can be decomposed on the surface of the HR 1 without coming away therefrom. This signifies that the effect of scraping off the offset toner by the bristles 7 of the brush roller 3 is prevented by substantially equalizing the peripheral speeds of the HR 1 and the brush roller 3. Thus, the offset toner can be removed by the use of the following recording paper for printing 4 and without the appearance of perceivable misprints and without spreading offset toner, thus polluting the interior of the fixing apparatus.

Preferably, the brush roller 3 may be disengageably mounted in contact with the HR 1 and brush roller 3 is intermittently brought into contact with HR 1. According to the inventors' experiment, in a case where the HR 1 on which the offset toner 6 did not exist was employed and where one page of an A4-sized sheet was fixed without holding the brush roller 3 in contact with the HR 1, about 8 toner particles within 2 $mm^2$ on the average migrated onto the HR 1 due to the offset. At this point of time, the maximum particle size of the offset toner 6 was 20 μm. At this size, the toner particles are not perceived as a picture. In the fixing of the next page, 6 of the 8 particles remigrated onto and where carried away by the next sheet of the recording paper 5. When such operations were repeated, the particle sizes of the offset toner 6 on the surface of the HR 1 gradually enlarged. Meanwhile, the smallest pattern among pictures to be fixed by this fixing apparatus is a picture indicated as a dot, for example, a decimal point in a numeral string. In the case of causing the offset toner 6 to remigrate onto the recording paper 4 and when the size of a black dot appearing on the recording paper 4 due to the remigration on that occasior is equal to the size of the decimal point, the dot is perceived as the picture. The size of the decimal point of a recording equipment in this embodiment was 0.25 mm in diameter. In this fixing apparatus, the maximum diameter of a black dot ascribable to the remigration of offset toner was set at 0.1 mm as a value clearly distinguishable from the above diameter of a decimal point, and such black dots were allowed to arise. Upon further continuing of the experiment, when the fixing of about 150 pages was finished, the offset toner 6 of large particle sizes giving rise to the black dot of 0.1 mm in diameter of the recording paper 4 appeared on the surface of the HR 1.

The diameter of each bristle 7 of the brush roller 3 is 10 μm, and the bristles are planted zigzag at intervals of 20 μm. When the offset toner 6 is disturbed by the brush in contact therewith, it can be decomposed into small particles having diameters of 15 μm or below. On the basis of the above experimental result, the brush roller 3 was brought into contact with the HR 1 each time 150 pages were printed. Even in this case, however, black dots of diameters larger than 0.1 mm attributed to the offset toner 6 appeared on the recording paper 4 when the time period of the printing was long. As the reason therefor, it has been revealed that, although the offset toner 6 is decomposed by the contact of the brush roller 3 therewith it is not removed from the surface of the HR 1 at the point of time. Further, when the experiment was conducted in detail, it has been revealed that the situation of existence of the offset toner 6 on the surface of the HR 1 immediately after the contact of the brush roller 3 is equivalent to the situation after the fixing of about 80 pages started from a state in which the offset toner 6 does not exist on the surface of the HR 1 at all. In view of this result, it has been decided to decompose the offset toner 6 in such a way that the brush roller 3 is brought into contact with the HR 1 every fixing of 70 pages. Thus, any black dot perceivable as a picture has been prevented from appearing on the recording paper 4, and it has become possible to remove the offset toner 6 with the recording paper for printing 4. According to this embodiment, the offset toner 6 is permitted to be favorably removed by the use of the recording paper for printing and without the appearance of misprints. Moreover, since the brush roller 3 is intermittently brought into contact with the HR 1, the wear lifetimes of the brush roller 3 and the HR 1 can be prolonged.

In the example described above, any black dot ascribable to the offset toner 6 and perceived as a picture does not appear. However the existence itself of very small black dots may still be perceivable by users. The mere existence of these very small black dots does not form misprints. However, these black dots if perceivable are not accepted by the users and are sometimes recognized as stains on the recording paper, so that they should preferably be eliminated. Unless especially gazed at, the black dots on the order of 50 μm are often unnoticed by sight. Accordingly, in order to prevent the black dots of 50 μm and above from appearing, when the contact cycle of the brush roller 3 is set at five pages in view of an experimental result similar to that mentioned above, the black dots visually perceivable are also prevented from appearing on the recording paper 4.

If the bristles 7 of the brush roller 3 have a low releasability for the offset toner 6, when the decomposition of offset toner 6 is repeated, the offset toner 6 existent on the surface of the HR 1 migrates onto the brush roller 3 and adheres to the bristles 7 in some cases. In an extreme case, the offset toner 6 having migrated acts as a final deposit and unites two to three of the bristles 7. This situation is equivalent to an enlargement in diameter of the bristles 7 so that the capability of decomposing the offset toner 6 is degraded. Accordingly, the bristles may preferably be coated with fluoroplastics in order to enhance the releasing effect of the bristles 7 of the brush roller 3 with respect to the offset toner 6 and to prevent the offset toner 6 from migrating from the HR 1 to the brush roller 3. According to this embodiment, the adhesion of the offset toner 6 to the bristles 7 of the brush roller 6 is decreased, so that the capability of the brush roller 3 for decomposing the offset toner 6 is not degraded even when the decomposition of the offset toner 6 is repeatedly performed. Incidentally, a similar effect is attained even when the fluoroplastics is employed for the material of the bristles 7 itself.

Figure 1:
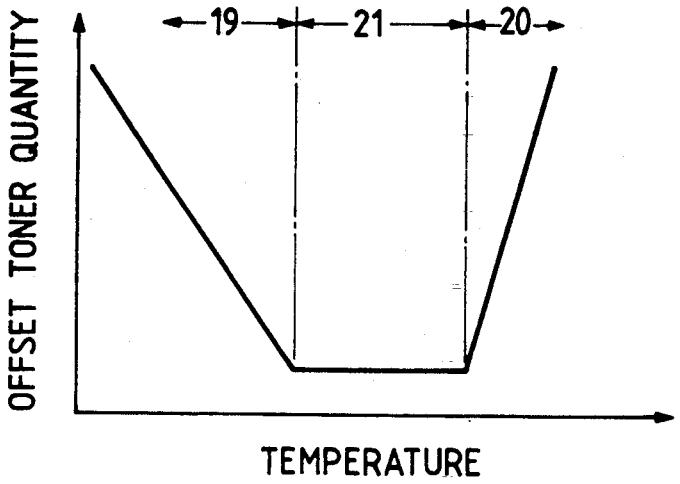
FIG. 1 is a diagram showing the appearing characteristic of offset toner.
Figure 2:
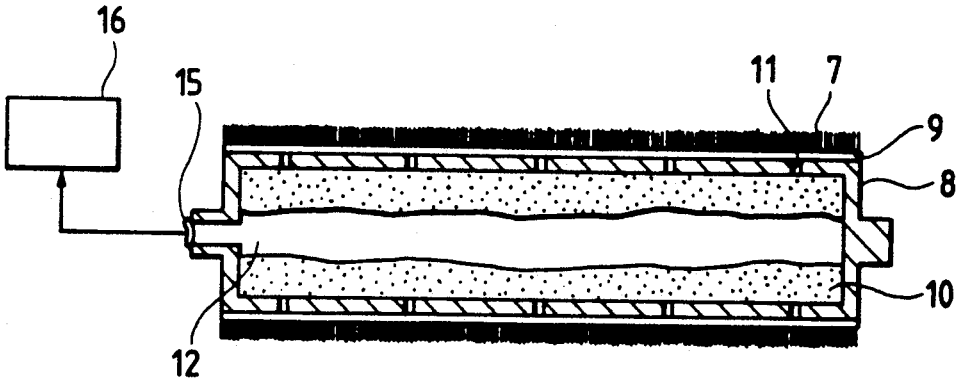
FIG. 2 is a sectional side view of a brush roller according to an embodiment of the present invention.

FIG. 2 shows a sectional side view of an embodiment of brush roller 3. Numeral 8 indicates a core, numeral 9 a regulation layer, numeral 10 a release agent, numeral 11 apertures, and numeral 12 air. Bristles 7 are planted on the regulation layer 9 wound around the surface of the cylindrical core 8. The release agent 10 is tightly enclosed in the internal space of the core 8, and the core 8 is provided with the apertures 11 for causing the release agent 10 to flow out. Nomex paper is employed as the material of the regulation layer 9, and silicone oil exhibiting 40,000 CS (Centistokes: coefficient of kinematic viscosity of oil, the larger the value of which signifies a higher viscosity) at the normal temperature is employed as the release agent 10. Since the brush roller 3 is heated by the HR 1, the viscosity of the release agent 10 contained therein lowers, and the pressure of the air 12 contained therein increases. Further, a centrifugal force is exerted on the release agent 10 by the rotation of the brush roller 3. Owing to the synergetic effect of the three actions of the viscosity lowering of the release agent 10, the increase of the internal pressure and the exertion of the centrifugal force, the release agent 10 flows out through the apertures 11 and is applied onto the surface of the HR 1, while the brush roller 3 is rotating. The surface of the HR 1 may be coated with the release agent 10 tightly enclosed in the brush roller 3, thereby enhancing the releasing effect of the HR 1, to consequently produce the effect of decreasing the quantity of the offset toner 6 which migrates from the recording paper 4 to the HR 1. Further, since the release agent 10 is applied onto the HR 1 through the bristles 7, the releasing effect of the bristles 7 is simultaneously enhanced. Accordingly, the offset toner 6 can be prevented from migrating from HR 1 to the bristles 7.

Figure 3:
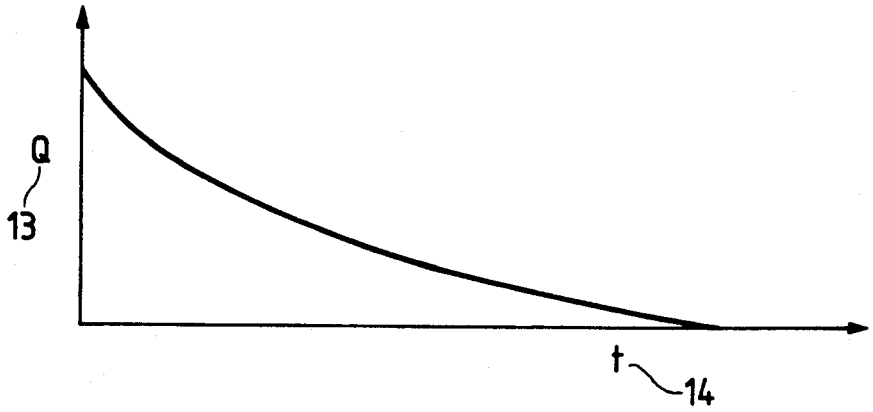
FIG. 3 is a diagram showing the outflow characteristic of a release agent during the continuous rotation of a brush roller.

FIG. 3 shows the outflow characteristic of the release agent 10 during the continuous rotation of the brush roller 3. Numeral 13 represents the flow rate Q of the release agent flowing out, and numeral 14 the time t of the continuous rotation. As the continuous-rotation time period 14 increases, the release-agent flow rate 13 decreases and finally becomes null to end the outflow of the release agent 10. The reason is that, as the inner space of the brush roller 3 filled up with the air 12 is enlarged by the outflow of the release agent 10, the air 12 has a constant mass, resulting in the lowering of the air pressure. Accordingly, to prevent the decrease of the release-agent flow rate 13 attributed to the air pressure lowering, the rotation of the brush roller 3 is stopped every fixed time period, the release agent 10 existent on the inner peripheral surface of the brush roller 3 is dropped in the gravitational direction, the apertures 11 are made penetrant to the air 12, and the brush roller 3 is replenished with the air 12. As a result the internal pressure rises again. In accordance with the lowering characteristic of the release-agent flow rate 13 obtained by an experiment, the HR 1 is favorably coated with the release agent 10 in such a way that, when the continuous-rotation time period 14 has reached 12 hours, the brush roller 3 is disengaged from the HR 1, whereupon the apertures 11 are made penetrant. Accordingly, the disengagement cycle of the brush roller 3 may be set at 12 hours in terms of the continuous rotation.

In a further preferable embodiment, the method of replenishing the brush roller 3 with air 12 may be used together with the method of intermittently bringing the brush 3 into contact with the HR 1. For example, the cycle of the contact is started every printing of 200 pages. In terms of a time period, the cycle of the contact of the brush roller 3 is equivalent to 200 seconds in this fixing apparatus. On this occasion, a time interval during which the brush roller 3 is in a rotating state is 190 seconds. On the other hand, a time period during which the rotation of the brush roller 3 is stopped is 300 seconds, the time period being required for gravitationally dropping the release agent 10 downwards and for making the upper apertures 11 penetrant to the air 12. Accordingly, the decrease of the release-agent flow rate 13 cannot be prevented merely by the short-time disengagement of the brush roller for decomposing the offset toner 6. In this embodiment, the brush roller 3 is brought into contact with the HR 1 or 10 seconds every printing of 200 pages. Further, when such a printing mode has proceeded continuously for 12 hours, the brush roller 3 is held disengaged from the HR 1 for 300 seconds, during which the printing is also stopped. Thus, the HR 1 can be favorably coated with the release agent 10, and hence, the cycle after which the brush roller is again brought into contact with the HR 1 can be widely prolonged, resulting in the effect that the wear lifetimes of the brush roller 3 and the HR 1 can be sharply prolonged.

In the embodiment of the brush roller 3 according to FIG. 2, numeral 15 indicates an internal pressure detecting film, and numeral 16 a pressure transducing circuit.

In this embodiment, the brush roller 3 is furnished with the internal- pressure detecting film 15 made of an elastic material. When the internal pressure has lowered, the internal pressure detecting film 15 is displaced inwards, and the magnitude of the displacement can be used for detecting the internal pressure through the pressure transducing circuit 16. The internal pressure detection is done only during the rotation of the brush roller 3. When the internal pressure falls below one atmosphere, the brush roller 3 is disengaged from the HR 1. Thus, the HR 1 can be favorably coated with the release agent 10.

Now, there will be explained an embodiment in which a tube made of fluoroplastics is used for the covering layer of the HR 1. By way of example, there are materials of trade names; PTFE (polytetrafluoroethylene resin) and PFA (ethylene terafluoride-fluoroalkoxy ethylene copolymer resin). Meanwhile, in a case where PFA coating is employed for the covering layer of the HR 1, outer periphery cutting for a constant covering thickness is carried out at the final stage of a process for manufacturing the HR 1. The outer-periphery cutting incurs the problem that a surface smoothness is spoiled. In the case of employing the fluoroplastics tube for the covering layer of the HR 1, the outer periphery cutting step is not required, and hence, the surface smoothness of the HR 1 remains good, so that the quantity of the offset toner 6 is conspicuously decreased. In this embodiment of the present invention, the fluoroplastics-tube roller is used, and quantity of the offset toner 6 is therefore remarkably small, to produce the effect that the cycle for the contact of the brush roller 3 can be prolonged.

Figure 5:
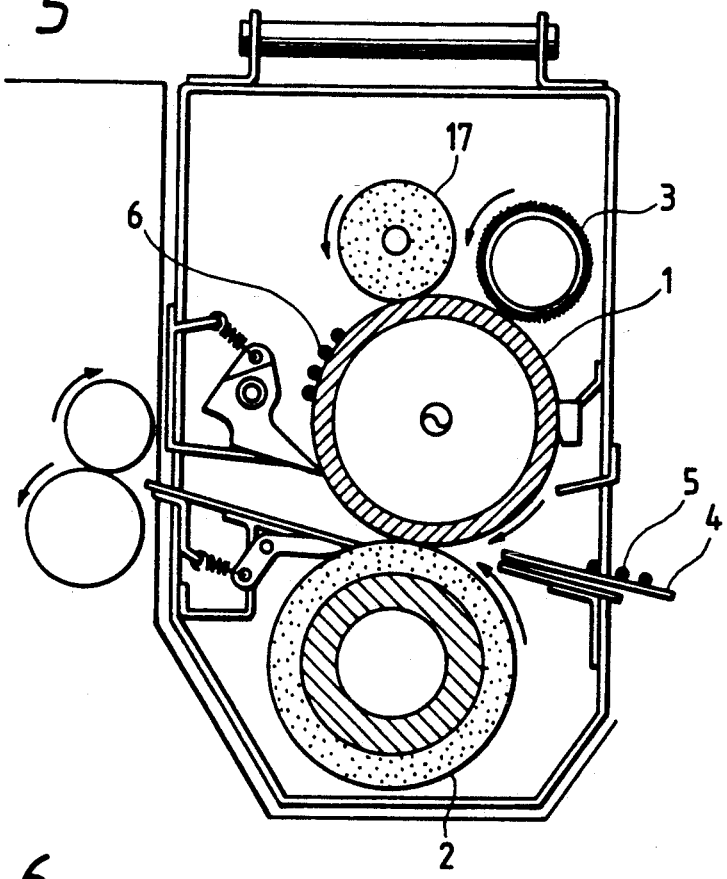
FIG. 5 is a sectional side view of a fixing apparatus according to an embodiment of the present invention.

FIG. 5 is a sectional side view of a fixing apparatus according to a second embodiment of the present invention. Numeral 17 designates a wiping roller. The wiping roller 17 is mounted so as to be freely brought into contact with an HR 1 or disengaged therefrom. When the wiping roller 17 has come into contact with the HR 1, all the offset toner 6 existing on the surface of the HR 1 at that time migrates onto the wiping roller 17, thereby to be removed from the HR 1. A material forming that surface of the wiping roller 17 which is brought into contact with the HR is sponge rubber of excellent wiping ability. Also in this embodiment, particles of the offset toner 6 are enlarged with an increase in the number of printed pages by the same phenomenon as elucidated in the first embodiment. In this embodiment, the wiping roller 17 is brought into contact with the HR 1 before the offset toner 6 reaches the size perceivable as a picture. The cycle of this contact is set at 150 pages on the basis of the same phenomenal observation as elucidated in the first embodiment. This set value is longer than the contact cycle of the brush roller for the reason that, when brought into contact, the wiping roller 17 deprives the HR 1 of all the offset toner 6 existing on the surface thereof. Thus, the black dot which is perceivable as the picture is prevented from appearing from recording paper 5, and the offset toner 6 is permitted to be removed using the recording paper for printing 4. Moreover, according to this embodiment, the wiping roller 17 wipes away the offset toner 6 only during the contact. Therefore, the pollution of the wiping roller 17 with the offset toner 6 lessens, and a time period till the exchange of the wiping roller 17 can be remarkably prolonged.

In a third embodiment of a fixing apparatus of the present invention according to FIG. 5 a wiping roller 17 and a brush roller 3 are mounted so as to be freely brought into contact with an HR 1 or disengaged therefrom. The brush roller 3 operates similarly to that of the first embodiment. In this embodiment, however, the printing is continued even for the time period of 300 seconds during which the brush roller 3 is disengaged after the printing of 12 hours. Wiping roller 17 is held in contact with the HR 1 during that time period only. According to this embodiment, offset toner 6 can be favorably removed without interrupting the printing.

Figure 6:
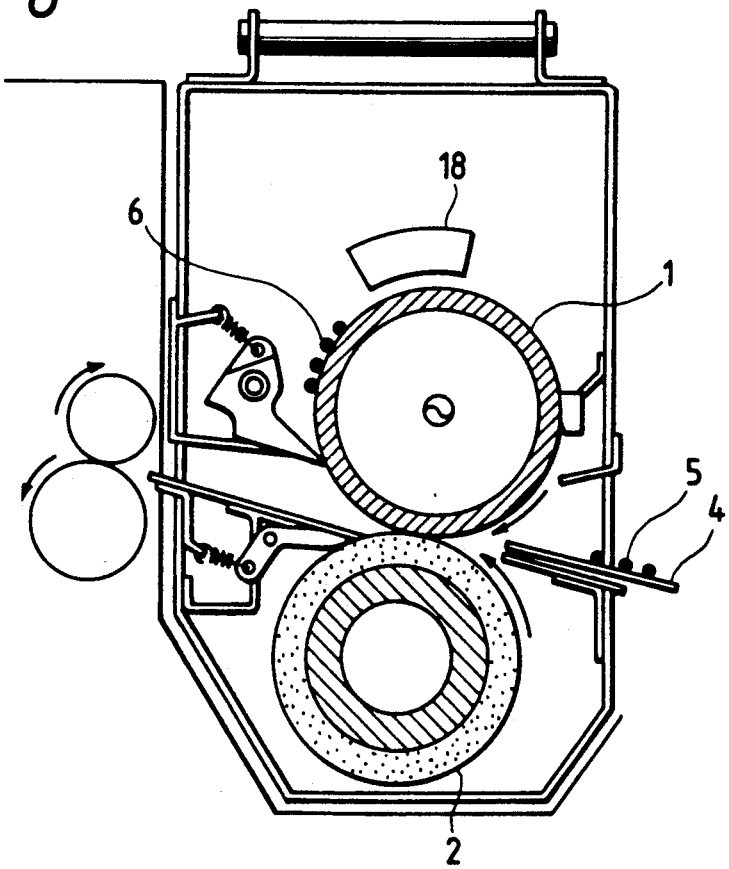
FIG. 6 is a sectional side view of a fixing apparatus according to an embodiment of the present invention.

FIG. 6 is a sectional view of a fixing apparatus according to a fourth embodiment of the present invention. Numeral 18 indicates an offset toner decomposing device. The offset toner decomposing device 18 radiates an ultrasonic wave to the surface of an HR 1. Thus, offset toner 6 existent on the surface of the HR 1 is vibrated and is decomposed into unperceivably small particles. More specifically, an ultrasonic vibration is transmitted to the melted offset toner, and a vibrating wave is propagated along the surface thereof, so that the melted toner surface is deformed into the form of the wave. As vibrational energy is intensified more, the difference between the crest and trough of the wave increases. At last, the vibration acts to tear up the melted toner, whereby the toner particle can be decomposed. The operation timing of the offset-toner decomposing device 18 is similar to the contact timing of the brush roller 3 stated above. According to this embodiment, the offset toner 6 can be decomposed in non contacting fashion, to produce the effect that the adhesion of the offset toner 6 to the offset-toner decomposition means does not take place.

The offset-toner decomposing device 18 may be such that a high frequency voltage is applied to a surface confronting the HR 1. The offset-toner 6 is vibrated and is decomposed into unperceivably small particles by the high-frequency potential of the offset-toner decomposing device 17. More specifically, when an electrode is disposed near the melted toner and has a voltage applied thereto, electric charges induced by the electrode are created within the toner, and an attractive force toward the electrode acts on the toner. Simultaneously therewith, an attractive force toward the heat roller acts owing to inversion-image charges created in the heat roller. Thus, the toner is deformed into a centrally-constricted state. At this time, a plastic deformation and elastic deformation coexist in the deformation of the toner. When the voltage application is ceased, the toner is restored in correspondence with the elastic deformation to enlarge the diameter of the constricted part, but it is not completely restored into its original shape. By repeating such operations, the constricted part is gradually narrowed and is finally torn up.

Furthermore, the offset toner decomposing device 18 may be a xenon flash lamp and is disposed at a surface facing the HR 1. A light emitting cycle in the continuous light emission of the xenon flash lamp is given by L/V where L denotes the peripheral length of a flashlight irradiation region on the surface of the HR 1, while V denotes the peripheral speed of the HR 1. Since the offset toner 6 is abruptly heated by the flashlight of the xenon flash lamp, it is explosively fused together with boiling or a chemical change. As a result, it is decomposed into particles which are too small to be perceived.

Now, there will be explained an embodiment of a fixing roller of the present invention that decreases the amount of offset toner occurring in the non-offset band.

The inventors of the present invention have found that reducing a torque fluctuation of the fixing roller leads to a reduction of offset toner formation.

Figure 7:
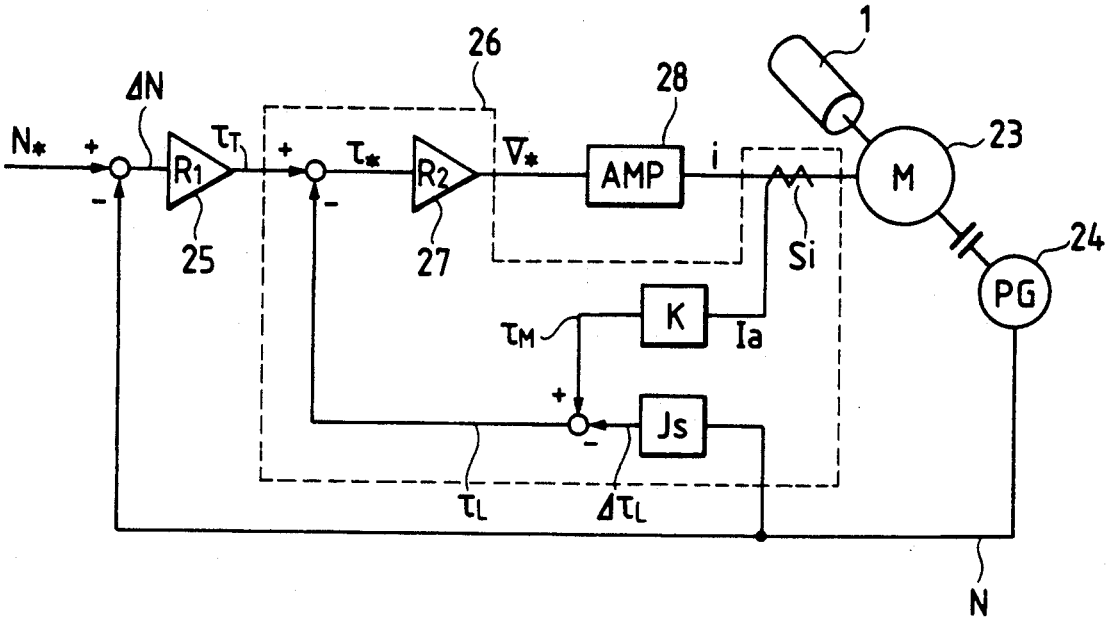
FIG. 7 is a diagram showing a torque control circuit in an embodiment of the present invention.

The change of the load current of the above mentioned HR drive motor may be understood as a change of torque of the HR drive motor. Therefore, it is possible to decrease the amount of the offset toner by controlling the torque of the HR drive motor. FIG. 7 shows an embodiment of a torque control circuit of the HR drive motor.

In FIG. 7, the HR 1 is driven by a drive motor 23. A pulse generator 24 generates a number of pulses corresponding to the number of revolutions per minute (rpm) N of the motor 22. A speed regulator 25 calculates a torque instruction value $\tau_T$ by integrating the differential value $\Delta N$ between a preset rpm N* and a present rpm, because a torque change $\Delta\tau$ may be expressed by multiplying a differential value $\Delta N$ by a moment of inertia J of an armature of the drive motor 23 (so-called Proportional Integration Control). A torque control circuit 26 controls load current (i.e. armature current) of the motor 23 in order to decrease the torque fluctuation of the motor 23. In the torque control circuit 26, a current detector Si detects the armature current Ia of the motor 23, the armature current Ia is multiplied by K and a torque $\tau_M$ is calculated. A torque change $\Delta\tau_L$ may be expressed by multiplying a differential value $\Delta N$ of the rotating number N by a moment of inertia J of the armature, therefore a load torque $\tau_L$ (an estimated value) is calculated as $(\tau_M - \Delta\tau_L)$. The load torque $\tau_L$ is fed back to the instruction torque $\tau_T$. A torque regulator 27 calculates a present speed value V* by integrating the value $(\tau_T - \tau_L)$. The speed value V* calculated by the torque control circuit 26 is power converted by an amplifier 28.

Figure 8:
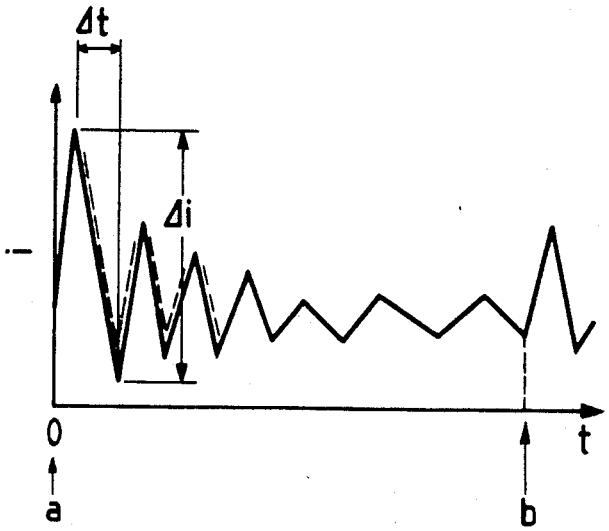

FIG. 8 shows a change of the load current for the HR 1 drive motor as a function of time starting from the inrush of the front end of the recording paper which passes through the contacting surfaces between HR and BR where i denotes current, t denotes time, a denotes a value of i at the inrushing of the front end of the paper while b does that at discharging the end of the paper, $\Delta i$ is a width of change in the current, $\Delta t$ being a time span corresponding to the width of change in the current. This diagram represents the case where recognizable offset has a occurred in the non-offset band 21 even at the passage of a first sheet of recording paper. In this example, an offset speckle with a diameter larger than 50 $\mu$m is defined as recognizable offset. The inventors of the present invention have found that when recording paper was inrushed to be passed between the contacting surfaces between HR and BR, there occurred a load current fluctuation for the HR drive motor as shown in FIG. 8, thereby producing recognizable offset in response to current change even in the non off set band 21. The broken lines in FIG. 8 indicate where recognizable offsets have occurred. As shown above regardless of increased or decreased current changes due to the current fluctuation, any significant current changes give rise to recognizable offset.

Figure 9:
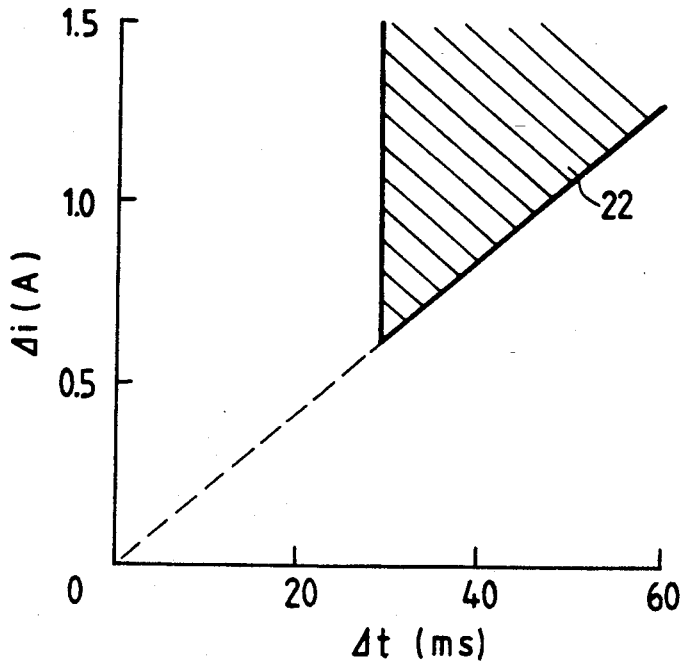
FIG. 9 defines the area where perceivable offset occurs.

FIG. 9 shows an area in a diagram where the recognizable offset has been observed, as plotted in the relationship between the current change width $\Delta i$ and time span $\Delta t$. Slashed area 21 indicates a region in the diagram where recognizable offset arises even in the non off-set band 21. This has been obtained by collecting a large number of samples of FIG. 8 and analyzing their data with respect to the current change with $\Delta i$ and time span $\Delta t$. As a result, it has been revealed that recognizable offset would occur in a range where a change factor $\Delta i/\Delta t$ for the current change $\Delta i$ is greater than 17.5 A/s and a time span $\Delta t$ is greater than 28.5 ms. In a case where a DC motor is utilized as an HR drive motor, $\Delta i$ may be substituted by a direct current in calculation, and that in a case where a drive motor driven by alternating currents, for example, an induction motor is used, $\Delta i$ may be substituted by effective values to yield the same result as in the FIG. 8.

It may be thought that the load current fluctuation of the HR drive motor (i.e. the torque fluctuation of the HR driver motor) is mainly caused by the impact shock by the front end of the recording paper entering between the rollers. Therefore, it is possible to decrease the torque fluctuation of the HR drive motor by controlling the impact shock by the front end of the inrushing paper. As a result, the amount of the offset toner is decreased. Now an embodiment of the fixing roller to decrease the impact shock by the front end of the inrushing paper will be explained.

Figure 10:
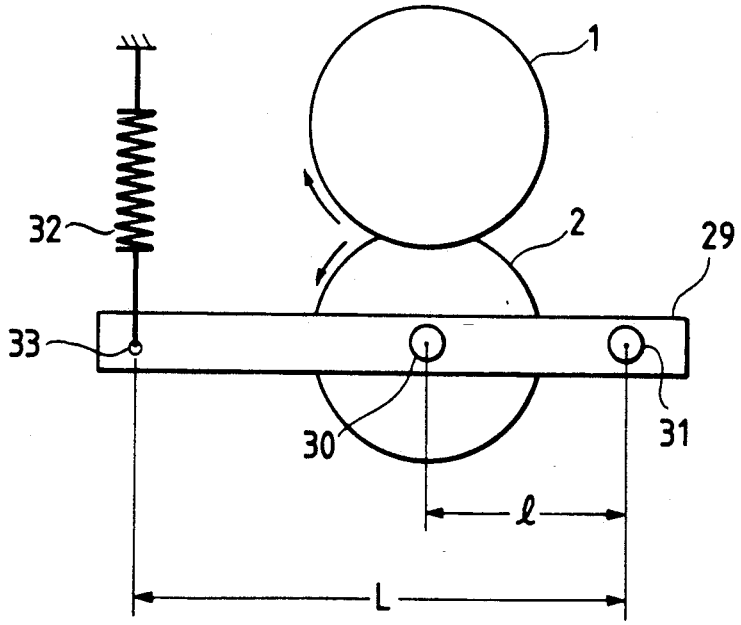
FIG. 10 shows a side view of the pressure applying mechanism for pressing BR against HR.

FIG. 10 shows a side view of the pressure applying mechanism for HR and BR to hold them pressed against each other. Numeral 29 indicates a pressure carrying member, 30 the center of rotation of BR, 31 the center of rotation of the pressure carrying member, 32 a spring for providing pressure, 33 a linkage position for fastening the spring 32 on the pressure carrying member 31, l indicates a distance between the center of rotation of BR 30 and the center of rotation of the pressure carrying member 31, and L indicates a distance between the center of rotation of the pressure carrying member 31 and the fastening position 33 on the pressure carrying member 31 for the pressure spring 32. The pressure applying spring 32 suspends the pressure carrying member 29 by its spring force, thereby the pressure carrying member 29 is rotated upward with the center of rotation 31 as a supporting point, pressing BR against HR. Although only a single sided view is shown in FIG. 10, the same mechanism is also provided on the other side.

The force to press BR against HR is referred to as press force F. When an elongation pressure applying spring 32 with spring constant k is given by x, an initial press force $F_0$, when no recording paper passes through, is given by the following equation.

$$F_0 = 2 \cdot k \cdot (L/l) \cdot x \quad (1).$$

On the other hand, when recording paper passes therebetween, and a thickness of the paper is given by $\delta x$, press force $F_1$ will be represented as follows.

$$F_1 = 2 \cdot k \cdot (L/l) \cdot (x + \delta x \cdot (L/l)) \quad (2).$$

Here, the impact shock by the front end of the inrushing paper is proportional to a difference between the press forces whether or not a recording paper, which relationship will be shown as follows when indicating the inrush impact as Fi.

$$Fi \alpha F_1 - F_0 \quad (3).$$

Further, according to the construction of the mechanism, $F_1 - F_0$ may be rewritten as follows.

$$F_1 - F_0 = 2 \cdot k \cdot (L/l)^2 \cdot \delta x \quad (4).$$

The difference in the press forces between when a recording paper is being passed and when no recording paper is being passed is divided by a thickness of the recording paper, and the quotient is defined as impact factor K. A value of impact factor K multiplied by a thickness of a recording paper being proportional to an impact shock force, it is obvious that the smaller the impact factor K, the smaller the inrush impact shock force becomes. Impact factor K is obtained from equation (4) as $2 \cdot k \cdot (L/l)^2$. Thereby, the relationship between the aforementioned impact factor and the inrush impact forces may easily be understood from equations (3) and (4). Further, through decreasing of impact factor K which also decreases the inrush impact forces, the torque fluctuation of the HR drive motor may be minimized.

In other words, it is possible to reduce the fluctuation of the torque of HR drive motor by absorbing the impact shock by the front end of the recording paper entering between the rollers into the spring for providing pressure 26 and the pressure carrying member 23. The absorption of the impact shock is realized by using the spring 32 with a predetermined value of constant k. The inventors have conducted a series of fixing experiments by varying impact factor K, and obtained the following results.

Figures 11, 12:
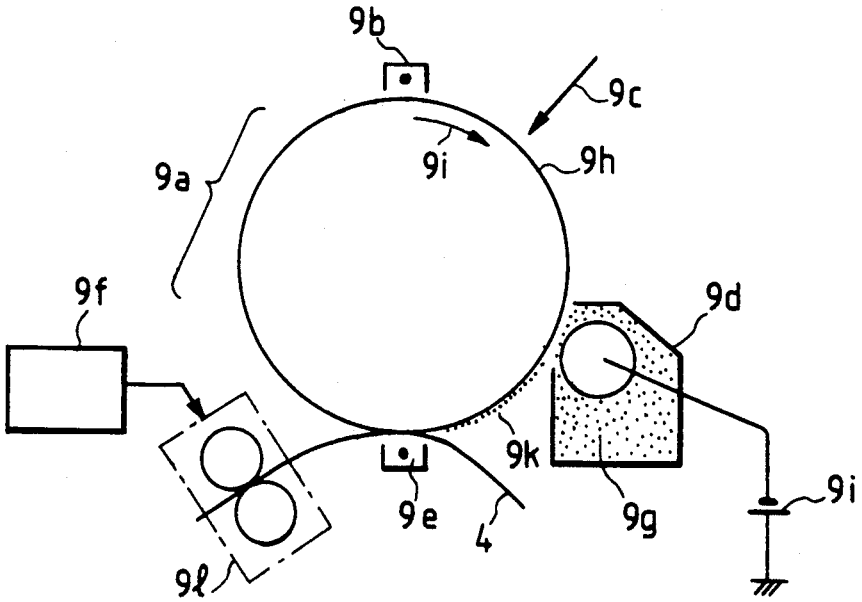
FIG. 11 summarizes the results of experiments conducted by varying impact factor K.
FIG. 12 is a constructional view of an electrophotographic recording equipment in which an embodiment of the present invention is used.

FIG. 11 summarizes the result of the experiments obtained by varying impact factor K in the non off-set band 21. In the column for the current fluctuation range in this figure, mark "x" indicates that there existed a current change which fell in the slant line area 22 in FIG. 9, in particular in the current changes that occurred in the HR drive motor, while mark "o" indicates that there existed no current changes that fell in the slant line area 22. Further, the column for recognizable offset in FIG. 11 indicates whether there occurred any recognizable offset in the experiments. According to FIG. 11, it is obviously understood that the current changes are small when the impact factor K is $4.0 \times 10^5$ (N/m) or less, thereby permitting no recognizable offset to occur.

As is clear from FIG. 8, a discharge shock by the end of a recording paper being discharged abruptly at b is generated, which is also proportional to impact factor K. It is feared that there may occur a recognizable offset when recording paper is continuously fed, or when another sheet of recording paper is inrushed while vibration still continues due to the discharge shock by the preceding sheet of the paper. According to this example, however, from the results as shown in FIG. 11, when the impact factor K is smaller than $4.0 \times 10^5$ (N/m), no current changes would occur which might fall in the slant line area 22 in FIG. 9, thereby precluding such possibilities.

Now the whole construction of an electrophotographic recording equipment to which the present invention is applied, is shown in FIG. 12. Referring to FIG. 12, the surface of a photosensitive member 9*a* rotating in the direction of an arrow 9*j* is uniformly charged by an electrifier 9*b*, and a static-charge latent image 9*h* corresponding to a recording picture signal is formed by exposure to light 9*c*. Toner is stuck by a developer 9*d* to which a bias 9*i* is applied, according to the potentials of the latent image, to form a toner image 9*k*. A recording paper is transported to a transferrer 9*i* and the developed image thus formed is transferred onto recording paper 4 by the transferrer 9*e*. The transferred recording paper 4 is transported to a fixer 9*l* and is fed to a fixer 9*l*, in which the transferred toner image is permanently fastened on the recording paper. Here, by means of a control circuit 9*f* for controlling a timing to start the decomposing process of an offset-toner decomposing apparatus disposed in the fixer 9*l*, it is possible to adopt a logic circuit consisting of a counter which counts the number of recorded pages printed in the course of the growth of the particle sizes of offset-toner, and a control circuit by which when a predetermined number has been reached, an output signal is produced and also the counter is reset so as to subsequently count the number of pages to be printed. According to this, it is possible to build a printer in which the timing for decomposing the offset toner is adjusted automatically in an artificial manner.

Further, the timing for the decomposition may well be determined by connecting the printer to an external computer unit and receiving a command from the computer, or a person may well give an instruction at any desired timing from a control panel disposed in the printer equipment. In short, when the characteristic of the growth of the particle sizes of the offset toner has been obtained beforehand, the timing for decomposing the offset toner can be adjusted without directly measuring the particle sizes.

In the above, the number of printed pages has been counted. However, in a case where the quantity of recorded information and the sorts thereof (the sorts of patterns such as characters, a photograph, and smearing) can be known before printing, the actual amount of toner consumption for the recorded information can be predicted, and hence, the information quantity and sorts of patterns based on the recorded information may well be utilized as estimate factors for controlling the timing.

We claim:

1. An apparatus for fixing a toner image formed on a recording medium having a first fixing roller which is rotatable wherein said first fixing roller is heated and said toner image is fixed on said recording medium being in pressed contact with said first fixing roller, wherein offset toner particles can form on said first fixing roller when said toner image is fixed on said recording medium; said apparatus further comprising a particle decomposer adapted to decompose said offset toner particles.

2. An apparatus according to claim 1, further comprising a second fixing roller which is rotated in pressed contact with said first fixing roller, wherein said recording medium is inserted between said first and second fixing rollers.

3. An apparatus according to claims 1 or 2, wherein said particle decomposer comprises a brush roller which is disengageably mounted in contact with said first fixing roller and is rotated relative to the rotation of said first fixing roller.

4. An apparatus according to claim 3, wherein the peripheral speed of said brush roller is substantially equal to that of said first fixing roller so as to prevent scraping off offset toner by said brush roller.

5. An apparatus according to claim 3, wherein said brush roller includes a cylindrical member having bristles arranged on a surface of said cylindrical member.

6. An apparatus according to claim 4 wherein said brush roller includes a cylindrical member having bristles arranged on a surface of said cylindrical member.

7. An apparatus according to claim 5, wherein said bristles are planted on a layer around said surface.

8. An apparatus according to claim 6, wherein said bristles are planted on a layer around said surface.

9. An apparatus according to claim 5, wherein said bristles are coated with fluoroplastics or made of fluoroplastics.

10. An apparatus according to claim 6, wherein said bristles are coated with fluoroplastics or made of fluoroplastics.

11. An apparatus according to claim 7, wherein said bristles are coated with fluoroplastics or made of fluoroplastics.

12. An apparatus according to claim 5, wherein said cylindrical member includes a gas and a release agent which are tightly enclosed in said cylindrical member and an aperture which enables said agent to flow out onto said surface.

13. An apparatus according to claim 12, wherein said brush roller further includes:

a pressure detector adapted to detect a pressure of said gas in said cylinder, wherein said brush roller is capable of being disengaged from said first fixing roller on the basis of the result obtained by said pressure detector.

14. An apparatus according to claim 3, further comprising a wiper which is disengageably mounted in contact with said first fixing roller, wherein said wiper is held in contact with said first fixing roller during disengagement of said brush roller from said first fixing roller.

15. An apparatus according to claim 3, further comprising a wiper which is disengageably mounted in contact with said first fixing roller, wherein both said wiper and said brush roller are simultaneously held in contact with said first fixing roller.

16. An apparatus according to claim 2, wherein a surface of said first fixing roller is formed with a covering layer which is a tube made of fluoroplastics.

17. An apparatus according to claim 1 or 2, wherein said particle decomposer comprises a vibrator mounted in non-contact with said first fixing roller, for vibrating said offset toner particles at predetermined intervals.

18. An apparatus according to claim 17, wherein said vibrator is an ultrasonic wave generator adapted to radiate onto a surface area of said first fixing roller.

19. An apparatus according to claim 17, wherein said vibrator is a high frequency voltage supplier adapted to apply a high frequency voltage between said first fixing roller and a surface area facing said first fixing roller.

20. An apparatus according to claim 17, wherein said vibrator is a xenon flash lamp adapted to irradiate a surface of said first fixing roller by light pulses.

21. An apparatus for fixing a toner image formed on a recording medium comprising:

a first fixing roller;

a drive motor adapted to rotate said first fixing roller, wherein said first fixing roller is heated and said toner image is fixed on said recording medium being in pressed contact with said fixing roller, and offset toner particles can form on said first fixing roller when said toner image is fixed on said recording medium; and a torque controller adapted to decrease a torque fluctuation of said first fixing roller, whereby the creation of said offset toner particles formed on said first fixing roller is decreased.

22. An apparatus according to claim 21, further comprising a second fixing roller which is rotated in pressed contact with said first fixing roller, wherein said recording medium is inserted between said first and second fixing rollers.

23. An apparatus according to claim 21 or 22, wherein said torque controller includes a torque control circuit to control a load current of said drive motor to decrease a torque fluctuation of said drive motor.

24. An apparatus according to claim 21, wherein said torque controller includes a shock absorber adapted to absorb a shock caused by the front end of said recording medium entering between said first and second fixing rollers, said shock absorber further applying a pressure to hold said first and second fixing rollers pressed against each other.

25. A facsimile apparatus for recording image signals converted from electric signals on a recording medium comprising an apparatus as claimed in any one of claims 1, 2 or 16.

26. An electrophotographic recording equipment comprising an apparatus as claimed in any one of claims 1, 2 or 16.

27. A facsimile apparatus for recording image signals converted from electric signals on a recording medium comprising an apparatus as claimed in claim 13.

28. A facsimile apparatus for recording image signals converted from electric signals on a recording medium comprising an apparatus as claimed in claim 14.

29. A facsimile apparatus for recording image signals converted from electric signals on a recording medium comprising an apparatus as claimed in claim 15.

30. An electrophotographic recording equipment comprising an apparatus as claimed in claim 13.

31. An electrophotographic recording equipment comprising an apparatus as claimed in claim 14.

32. An electrophotographic recording equipment comprising an apparatus as claimed in claim 15.

* * * * *

UNITED STATES PATENT AND TRADEMARK OFFICE

CERTIFICATE OF CORRECTION

PATENT NO. : 5,253,025
DATED : October 12, 1993
INVENTOR(S) : Teruaki Mitsuya, et al.

It is certified that error appears in the above-indentified patent and that said Letters Patent is hereby corrected as shown below:

| Column | Line | |
|---|---|---|
| 1 | 8 | After "relates" insert --to--. |
| 1 | 10 | Before "printer" insert --in a--. |
| 1 | 33 | After "abscissa" insert --axis--. |
| 4 | 13 | Change "6 of the 8" to --6 of the 8--. |
| 5 | 8 | After "perceivable" insert --,--. |
| 10 | 20 | After "decreased." start new paragraph. |
| 10 | 58 | After "paper" insert --is being passed-- |
| 10 | 62 | Change "Fi$\alpha$ $F_1$-$F_0$" to --Fi $\alpha$ $F_1$ - $F_0$--. |

Signed and Sealed this

Seventh Day of June, 1994

*Attest:*

Bruce Lehman

BRUCE LEHMAN

*Attesting Officer*

*Commissioner of Patents and Trademarks*